US007046262B2

(12) United States Patent
Feng et al.

(10) Patent No.: US 7,046,262 B2
(45) Date of Patent: May 16, 2006

(54) SYSTEM FOR DISPLAYING IMAGES ON A DISPLAY

(75) Inventors: Xiao-fan Feng, Vancouver, WA (US); Scott Daly, Kalama, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 345 days.

(21) Appl. No.: 10/404,204

(22) Filed: Mar. 31, 2003

(65) Prior Publication Data

US 2004/0189680 A1 Sep. 30, 2004

(51) Int. Cl.
*G09G 5/10* (2006.01)

(52) U.S. Cl. ..... 345/691; 345/204; 348/448; 710/5

(58) Field of Classification Search ..... 348/448; 345/691, 349, 441, 204, 60, 88; 349/4; 710/5
See application file for complete search history.

(56) References Cited

U.S. PATENT DOCUMENTS

| | | | | |
|---|---|---|---|---|
| 5,686,932 | A | 11/1997 | Tomita | |
| 5,739,804 | A | 4/1998 | Okumura et al. | |
| 5,748,169 | A | 5/1998 | Okumura et al. | |
| 6,229,512 | B1 | 5/2001 | Shigehiro | |
| 6,266,092 | B1 * | 7/2001 | Wang et al. | 348/448 |
| 6,392,630 | B1 | 5/2002 | Lin et al. | |
| 6,625,667 | B1 * | 9/2003 | Westerman | 710/5 |
| 2001/0024199 | A1 * | 9/2001 | Hughes et al. | 345/204 |

FOREIGN PATENT DOCUMENTS

| | | |
|---|---|---|
| EP | 0 951 007 B1 | 12/1999 |
| JP | 7-020828 | 1/1995 |
| JP | 7-56532 | 3/1995 |
| JP | 9-106262 | 4/1997 |
| JP | 11-219153 | 8/1999 |

OTHER PUBLICATIONS

Okumura, et. al., *7.3, Advanced Level Adaptive Overdrive (ALAO) Method Applicable to Full HD-LCTVs*, SID 02 Digest, pp. 68-71.
Nakanishi, et. al., *29.3 Fast Response 15-in. XGA TFT-LCD with Feedforward Driving (FFC) Technology for Multimedia Applications*, SID 01 Digiest, pp. 488-429.
Kawabe, et. al., *35.4 New TFT-LCD Driving Method for Improved Moving Picture Quality*, SID 01 Digest, pp. 998-1001.

* cited by examiner

*Primary Examiner*—Kent Chang
*Assistant Examiner*—Tammy Pham
(74) *Attorney, Agent, or Firm*—Chernoff, Vilhauer, McClung & Stenzel

(57) ABSTRACT

Processing of images for displaying on a display for displaying images on a liquid crystal display.

37 Claims, 6 Drawing Sheets

SYSTEM FOR DISPLAYING IMAGES ON A DISPLAY

BACKGROUND OF THE INVENTION

The present invention relates to the processing of images for displaying on a display, and in particular to the processing of images for displaying images on a liquid crystal display.

Video images are displayed on various display devices such as Cathode Ray Tubes (CRTs) and Liquid Crystal Displays (LCDs). Typically such display devices are capable of displaying on a display screen images consisting of a plurality of picture elements (e.g., pixels) which are refreshed at a refresh rate generally greater than 25 Hertz. Such images may be monochromatic, multicolor, full-color, or combinations thereof.

The light of the successive frames which are displayed on the display screen of such a CRT or LCD display device are integrated by the human eye. If the number of displayed frames per second, typically referred to as the frame rate, is sufficiently high an illusion of the images being displayed in a continuous manner and therefore an illusion of motion may be created.

The technique in which images are formed on the display screen of a CRT display is fundamentally different from the way in which images are formed on the display screen of a LCD display. On a CRT display device the luminance of a picture element is produced by an area of a phosphor layer in the display screen where the area is struck by a writing electron beam. On a LCD display device, the luminance of a picture element is determined by the light transmittance state of one or more liquid crystal elements in the display screen of the LCD display device at the location of the picture element, whereby the light itself originates from ambient light or a light source. For accurate reproduction of moving images or moving parts of an image, the luminance response of the used display device is important.

The luminance responses and the luminance response times of CRT and LCD display screens are different. The luminance response time, being the time needed to reach the correct luminance on the display screen in response to an immediate change in a corresponding drive signal, is shorter than a frame period for a CRT display device but up to several frame periods for a typical LCD display device.

For LCD display device, the luminance responses and the luminance response times are different for a darker-to-brighter luminance transition as compared to the responses and response times for a similar brighter-to-darker luminance transition. Further, the luminance responses and luminance response times are temperature dependent, drive voltage range dependent, and, due to production tolerances, unequal over the LCD screen area (location dependent).

One existing technique to change the luminance response times with LCD display devices is to attempt to shorten the overall luminance response times by over-driving all the signals of the display for the slower of the transition of darker-to-brighter and brighter-to-darker. While of some benefit in increasing the temporal response of the display, the resulting image still includes some flickering. Flickering may be observed, in many cases, as apparent flickering of an image as the image is moved around on the display. Flickering tends to be most pronounced when an image is viewed on a shaded background with a dotted pattern as well as vector art often used in computer aided drawings.

Another existing technique to change to luminance response times with LCD display devices is to slow down the transition of all pixels of the display from the darker-to-brighter brighter transition and the brighter-to-darker transition to the slowest transition within the display. This slowing down of the transition may be performed by modification of the driver waveform to achieve the slower temporal response. While slowing down the transition of all the pixels of the display results in a decrease in apparent flicker, unfortunately, the slowing down of the temporal response of the entire display result in objectionable motion blur because of the insufficient effective refresh rate.

EP 0 951 007 B1 disclose a de-flickering technique in which the video signal is modified so that the asymmetry of luminance rise and decay time is compensated. EP0 951 007 B1 is incorporated by reference herein. Referring to FIG. 7, FR which is representative of the present luminance output as it was predicted one frame before (previous frame) is subtracted from the input video signal. This difference and the present luminance output FR are the two inputs to the processing unit. The outputs of the processing unit are $\Delta C$ and $\Delta R$, where $\Delta C$ is the new correction value to be added to the present predicted luminance FR, and $\Delta R$ is the new prediction of luminance change after the next frame.

DETAILED DESCRIPTION OF THE PREFERRED EMBODIMENT

The present inventors considered the EP 0 851 007 B1 reference ('007 patent) and determined that the calculation of $\Delta R$ is based upon an assumption that the rising and decay times follow an exponential function with a time constant $\tau$ which may be inaccurate for many actual displays. In addition, the '007 patent builds up the luminance based on the prediction, thus any errors in prediction can cause a cumulative error in luminance which may likewise result in inaccuracies. Also, the '007 patent stores the predicted luminance value in a frame memory which is different from the video signal used to drive the LCD. This dual memory structure results in additional memory requirements increasing the expense of the display. Furthermore, the '007 patent only addresses the reduction of flickering artifacts and does not consider the temporal response speed of the display.

Figure 1:
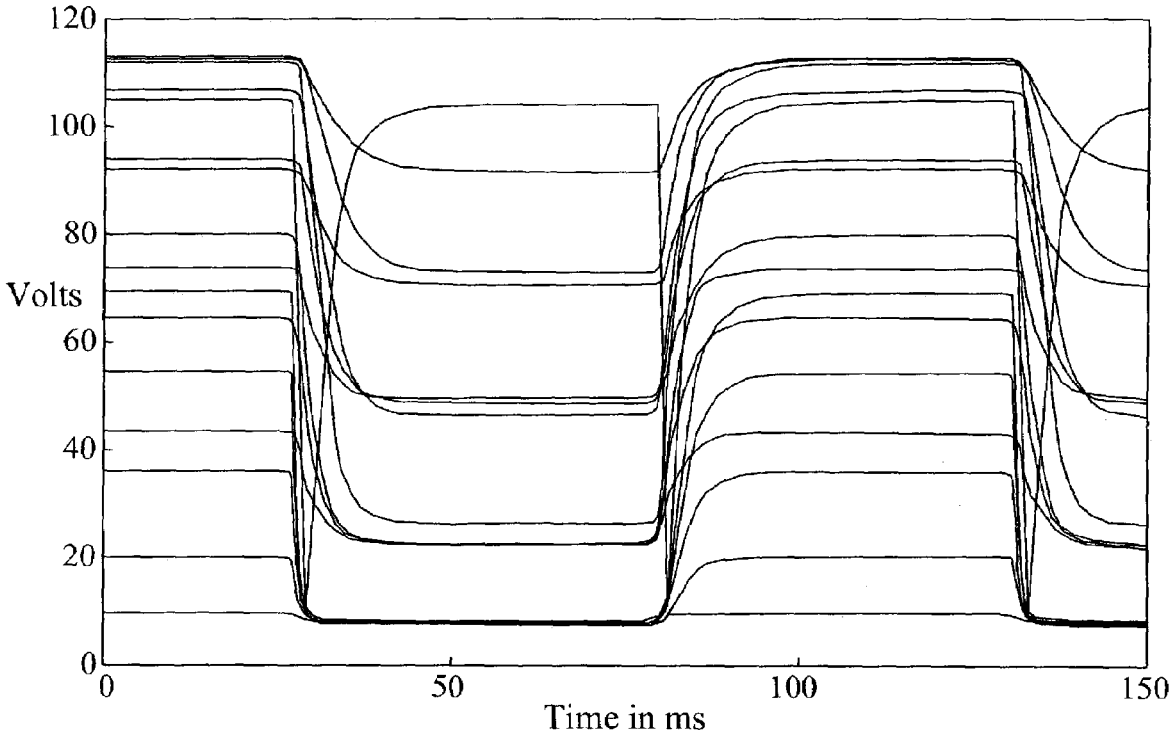
FIG. 1 illustrates temporal transitions for a liquid crystal display.

The present inventors came to the realization that a display system preferably simultaneously addresses both the reduction of flicker and maintaining a fast temporal response. Referring to FIG. 1, the different voltage levels and the different temporal transition times are illustrated. It may be observed that the temporal response of a liquid crystal display is in fact quite non-linear with the rising time between different transitions and the falling time between different transitions varying significantly. There is no particular pattern for the transition times readily observable in FIG. 1.

Figure 2:
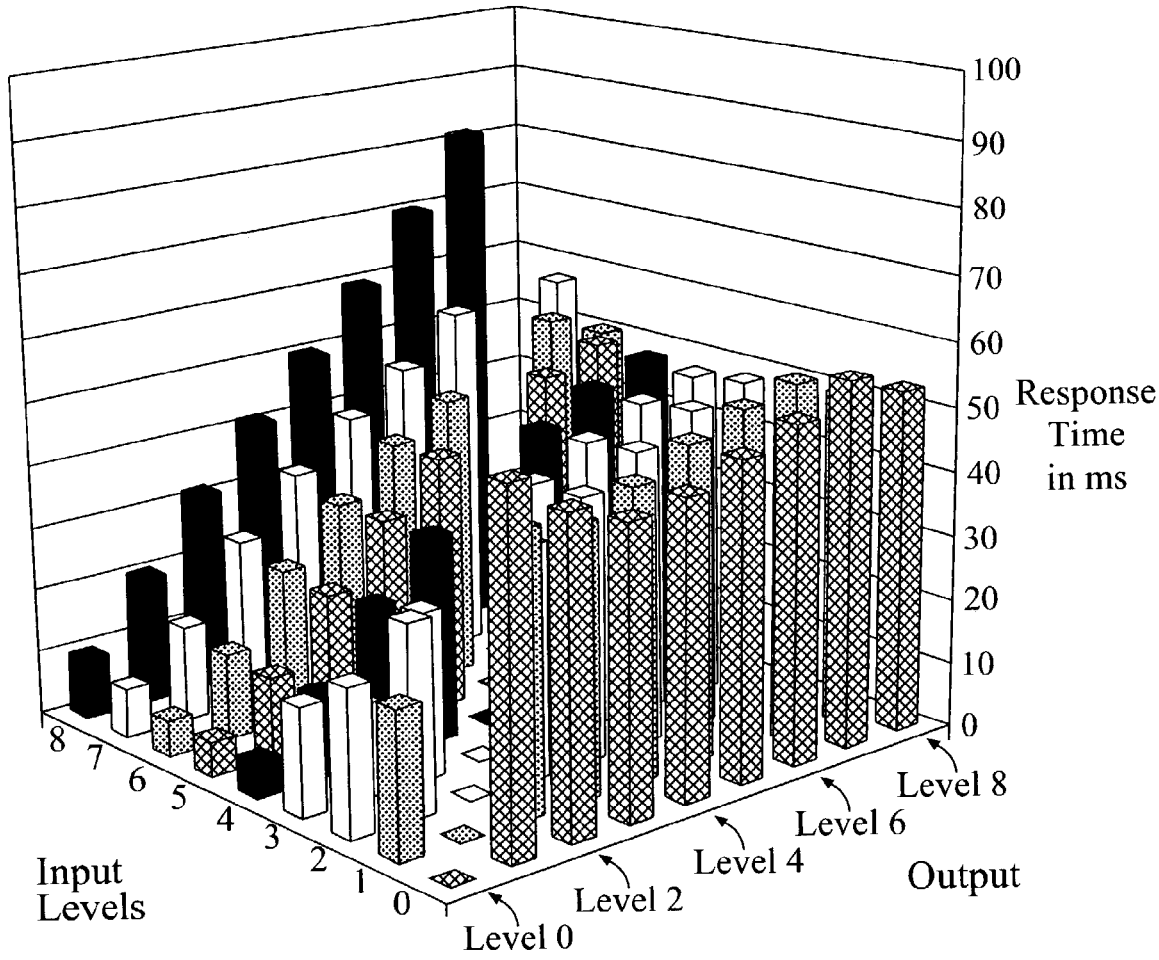
FIG. 2 illustrates the temporal response of a liquid crystal display.

After consideration of the lack of temporal patterns within a display the present inventors then considered illustrating the temporal transitions as a relationship between quantized input levels (9 levels) and quantized output levels (9 levels). Referring to FIG. 2, for one particular pixel the light-to-dark and dark-to-light transitions are illustrated on a graph. FIG. 2 illustrates an asymmetry between the different transitions. For example, where the quantized input level is near zero (black) the quantized output levels have a relatively constant response time. In addition, there tends to be a general decrease in the temporal response time with higher input levels and decreasing output levels (toward upper left hand comer of FIG. 2.). Also, for high quantized input levels (white) the temporal response time increases significantly for high quantized output levels (white) (toward upper encorder of FIG. 2). Accordingly, the light-to-dark transitions are relatively rapid while the dark-to-light transitions are relatively slow. This differential temporal response results in flickering of displayed images.

Temporal response measurements shown in FIG. 1 are somewhat difficult to effectively characterize so a quantized set of levels 0–8 from a grey scale of 0–255 (i.e., each level includes 32 grey levels) is illustrated in FIG. 2. Level 8 represents white, level 0 represents black, and the height represents the response time. It is noted that liquid crystal displays have no color dependence in the transitions because the color is due to color filters. The temporal response varies from generally less than 5 ms (switching from white to black) to in excess of 70 ms (switching from white to light gray). Shown in this manner it maybe observed that the asymmetry exists across the range of potential transitions of the display.

Typically designers of liquid crystal displays attempt to minimize the transition time between different states, or otherwise design the fastest optical materials possible. To further minimize the transition time between different states an overdrive technique may be used to more rapidly drive the display to the desired state. The change from one state to another state is typically performed by changing the voltage applied to the electrodes between a pair of frames and thereafter waiting for the liquid crystal material to sufficiently change to provide the desired output. The overdrive technique typically temporarily imposes between the pair of electrodes a voltage greater than the voltage for the desired output. At some point, such as prior to the time required to reach the desired output or shortly thereafter, the voltage is modified to provide the desired output. There is limited, if any, concern by such designers of liquid crystal displays other than to minimize the transition time. In many cases, with sufficiently fast transition times and sufficient overdriving, the overall motion blur for a display can be reduced. It is noted that the quantized levels illustrated in FIG. 2 are merely for purposes of illustration and not necessarily included within any particular drive scheme.

After a detailed analysis of the overdriving techniques applied to existing displays, the present inventors determined that many of the transitions, such as from a low voltage value (i.e., white) to a high voltage value near the display maximum (i.e., black) there is no need to overdrive the display, on the other hand, from lack (i.e. high voltage) to white (i.e. low voltage) there is no opportunity to overdrive the display without exceeding the maximum voltages provided by the voltage drivers. In this manner, there are some transitions that can not be overdriven to achieve a faster transition time and thus the undesirable asymmetry is actually exaggerated in many respects between those transitions that can be overdriven and those transitions that can not be overdriven.

Figure 3:
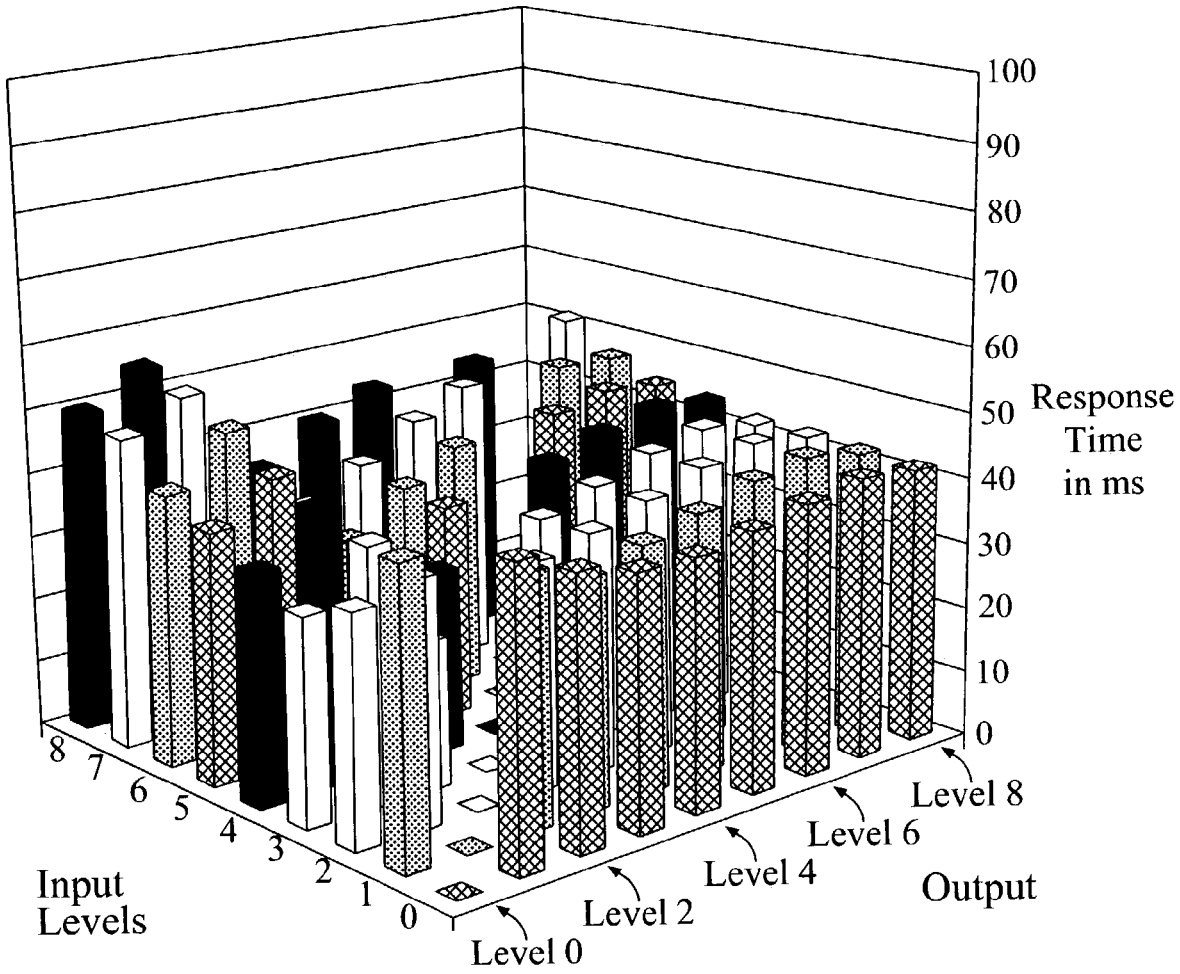
FIG. 3 illustrates a modified temporal response of a liquid crystal display.

After consideration of the inability to overdrive the display for many of the transitions, and the resulting exaggeration in asymmetry, the present inventors came to the realization that selective overdriving of some transitions in combination with selective slowing of some other transitions may be used to achieve a more uniform overall set of transitions across the display. The selective overdriving of the slower transitions assists in reducing the overall motion blur of images because of the selective decrease in the temporal response time (i.e. faster responses between states) of the display. Similarly, the selective slowing of some of the faster transitions reduces the temporal response time of the display which is generally considered undesirable, but has the beneficial effect of a reduction in the flickering of images displayed on the display. The simultaneous overdriving of the display and slowing of the temporal response of the display is an unlikely combination. However, simultaneously selectively overdriving some of the transitions and selectively slowing other transitions may achieve an overall more equalized set of transitions, such as shown in FIG. 3. In general, the result is to decrease the temporal response of at least one pixel while simultaneously increasing the temporal response of at least one other pixel of the display, such as using an overdriving technique. Other techniques may be used to increase the temporal response of the display, if desired.

Figure 4:
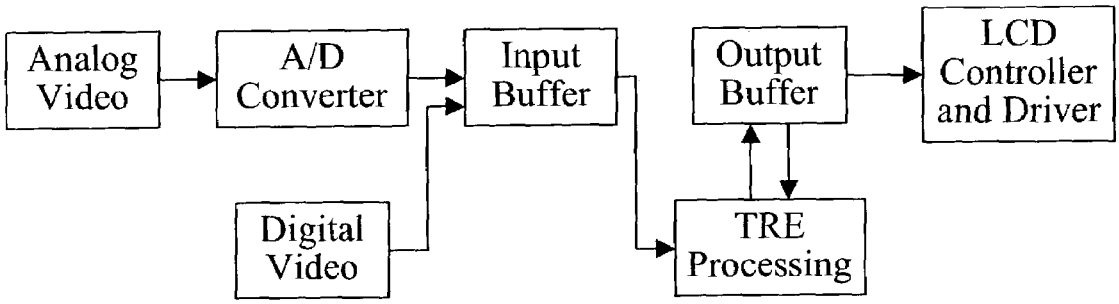
FIG. 4 illustrates a system diagram for modification of the input to the LCD display.

Referring to FIG. 4, an image processing technique receives an analog video image in any desirable format. The analog video image is preferably converted to a digital video image using an analog-to-digital converter. Alternatively, a digital video image may be received in any desirable format. An input buffer receives the digital video signal, which may simply be a first-in-first-out buffer or otherwise any buffer structure. The input buffering is primarily included to provide limited buffering for the input signal, where the input buffer preferably has less storage than 10%, 25%, 50%, or 75% of a frame. The input buffer provides input to a temporal response equalization processing module. The temporal response equalization acts to selectively overdrive some transitions and selectively slow other transitions. The output of the temporal response equalization processing module is provided to an output buffer. The output buffer is primarily included to provide limited buffering for the output signal, where the output buffer preferably has sufficient storage for a single frame. For example, the output buffer may have sufficient storage for 75% or more of a frame, 90% or more of a frame, 100% of a frame, 110% or less of a frame, 125% or less of a frame, 150% or less of a frame, though normally less than 200% of a frame. The output buffer may be shared with the LCD driver circuit to reduce the need for additional memory requirement as a result of the temporal response equalization processing. In this manner, the total memory requirements for the LCD driver circuit and output buffer (which may be the same if desired) is 75%, 90%, 100%, 110%, 125%, 150%, 200%, as previously discussed. The output buffer provides a feedback input to the temporal response equalization processing module and an input to the LCD driver circuit.

The temporal response equalization processing may be implemented using any suitable processing technique. In many displays, the temporal duration of the slowest response and the fastest response has a factor of approximately 10–15 times (5 ms vs. 80 ms or 5 ms vs. 50 ms). The temporal response equalization preferably results in a display with a temporal range between the slowest response and the fastest response that has a factor of less than 5 times, more preferably less than 3 times, more preferably less than 2 times, and more preferably less than 1 time. The temporal range for these factors is preferably determined based upon a majority of the transitions, greater than 75% of the transitions, greater than 85% of the transitions, greater than 95% of the transitions, greater than 97% of the transitions, or 100% of the available transitions. In this manner, the temporal response profile may be similar to that illustrated in FIG. 3. The selective overdriving and selective slowing of the transitions may be represented or implemented in any manner, including for example a look-up table, if desired.

The preferred temporal response equalization processing technique includes using a temporal infinite impulse response (IIR) filtering, so that only one frame buffer memory is necessary. In this manner, the output is the current frame plus the previous output ($O_i(x,y)=O_{i-1}(x,y)(1-k)+kI_i(x,y)$). As a result, the effect of frames more temporally distant from the current frame will have a reduced contribution to the filtering. By using a temporal infinite impulse response filter a single frame buffer approximately the same size as an image frame (e.g., +/−5%, 10%, 15%) may be used within the display that may likewise be shared by the LCD driver circuitry. Alternatively, other types of filters may likewise be used that make use of a single frame buffer approximately the same size as an image frame (e.g., +/−5%, 10%, 15%) shared by the LCD driver circuitry.

Figure 5:
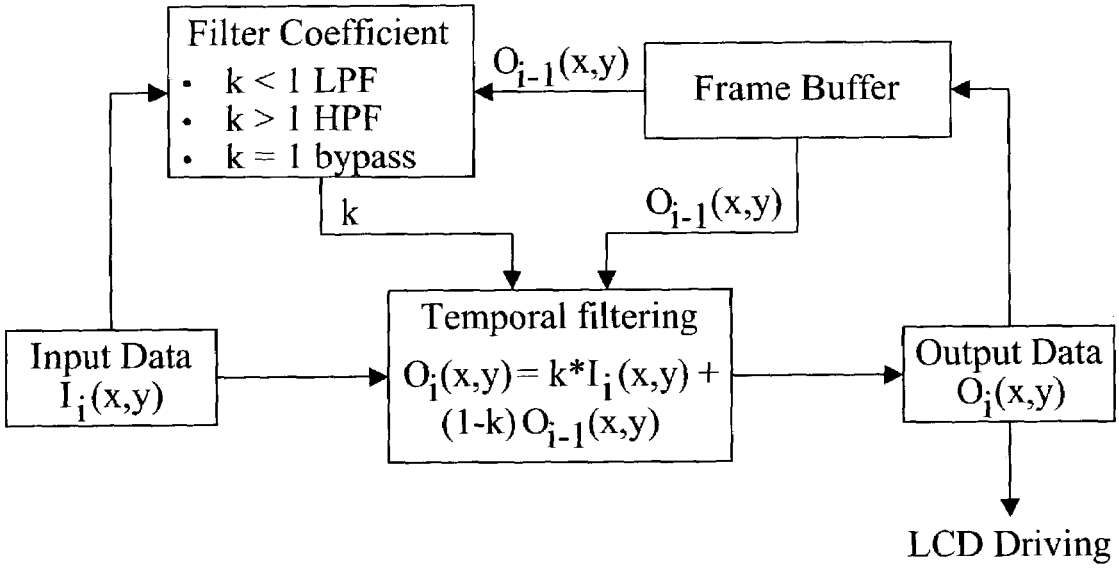
FIG. 5 illustrates a flow diagram for an exemplary temporal response equalization filter.

Referring to FIG. 5, the input data may include $I_i(x,y)$ where I is the intensity of a particular pixel, i is the frame, and x,y is the spatial location of the particular pixel within the display. A filter coefficient may be selected, namely, k. When the target level $I_i$ in comparison to the old level $O_{i-1}(x,y)$ from the frame buffer has too fast of a transition the k is set to less than 1 (k<1) indicating a low pass filter. When the target level $I_i$ in comparison to the old level $O_{i-1}(x,y)$ from the frame buffer has too slow of a transition the k is set to greater than 1 (k>1) indicating a high pass filter. Alternatively, k is set to 1 (k=1) indicating that no additional filtering of the signals is necessary.

The temporal filtering may include setting a new output value $O_i(x,y)$ equal to the factor k multiplied by the current frame $I_i(x,y)$ as modified by the factor (1−k) multiplied by the previous output $O_{i-1}(x,y)$. The output data is the output of the temporal filtering, namely, $O_i(x,y)$. The output data $O_i(x,y)$ may be stored in the frame buffer for the subsequent frame. It may be observed, that while the output data is dependent, at least in part, upon one or more previous frames, there is preferably no dependance on the spatial location within the display. Preferably, the temporal IIR filter is performed in a linear luminance domain because the flickering is related to an additive process of luminance over time. Gamma correction may be implemented using a 1-dimensional lookup table to perform inverse gamma correction before filtering and another 1-dimensional lookup table to perform gamma correction after filtering.

Figure 6:
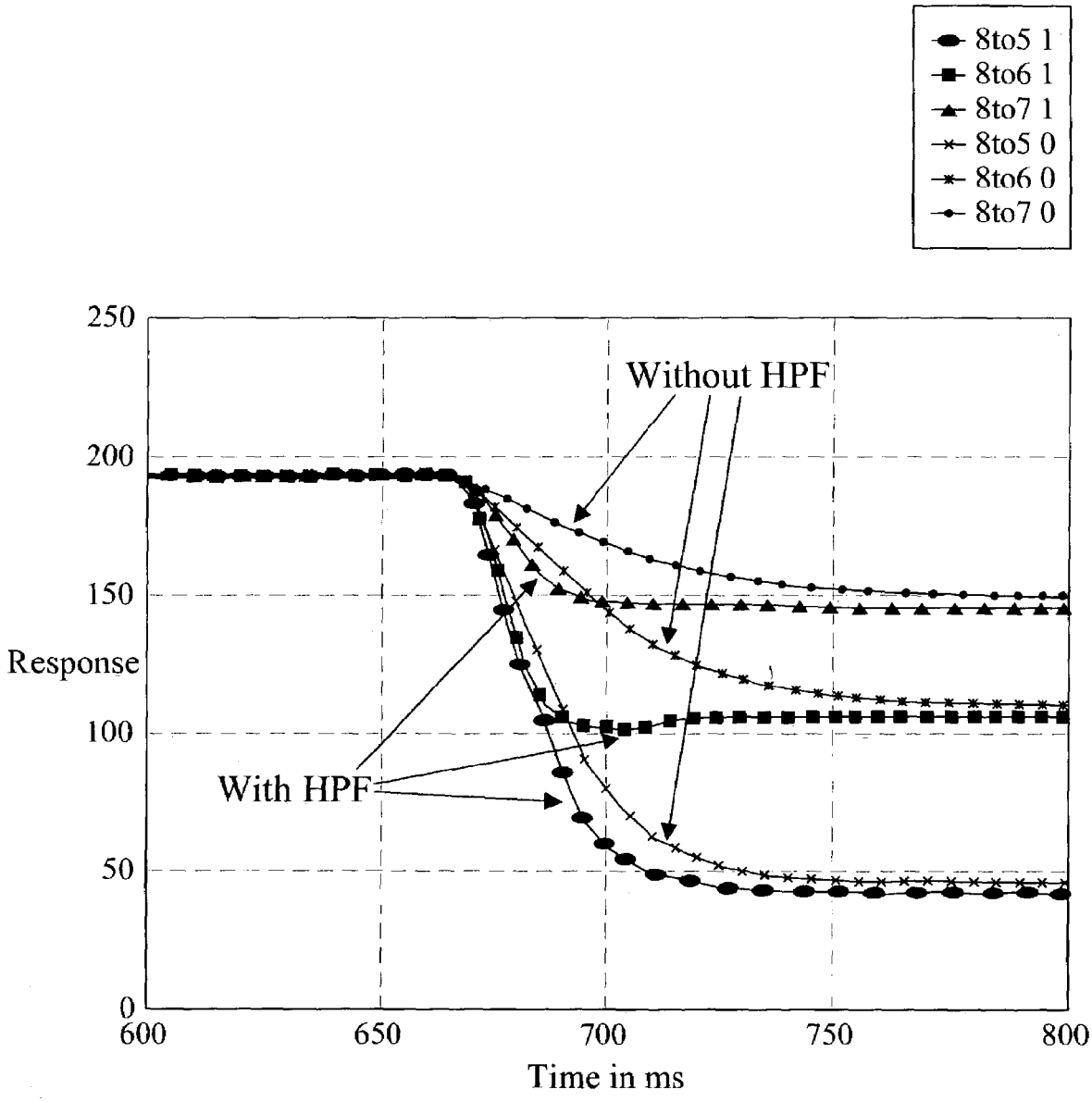
FIG. 6 illustrates an improved temporal response with an overdrive technique.
Figure 7:
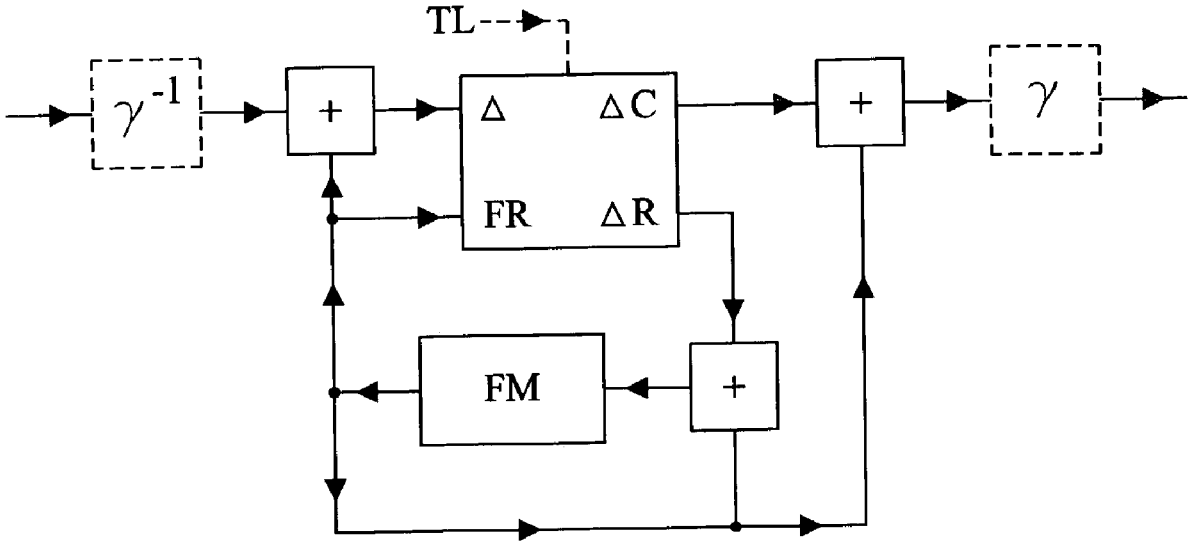
FIG. 7 discloses an existing de-flickering technique.

In one particular implementation if $I_i(x,y)<64$, and $O_{i-1}(x,y)>I_i(x,y)$ then k is set to 0.5; else if $I_i(x,y)>O_{i-1}(x,y)$, and $O_{i-1}(x,y)>200$ then k is set to 1.7; else k=1. Referring to FIG. 6, by way of illustration the three longest transitions from white to gray with and without a temporal high pass filter is illustrated. The use of an over-drive technique illustrates an improved transition time.

It is to be noted that the techniques discussed herein may likewise be applied to other display technologies that have different temporal responses dependent upon the changes in intensity.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A method of modifying an image to be displayed on a display, said image defining a first frame of displayed video having an array of pixels and replacing a second image defining a second frame of displayed video immediately preceding said first frame and having an array of pixels spatially matching that of said first frame, said method comprising;

(a) receiving said image; and (b) modifying said image by increasing the temporal response of at least one pixel of said second frame of said displayed video being replaced by a spatially matching pixel of said first frame of displayed video while simultaneously slowing the temporal response of at least one pixel of said second frame of said displayed video being replaced by a spatially matching pixel of said first frame of displayed video.

2. The method of claim 1 wherein increasing the temporal response is as a result of overdriving.

3. The method of claim 1 wherein the ratio of the temporal duration of the fastest response to the slowest response capable of being displayed by said display as a result of said modifying has a factor of less than 5 times.

4. The method of claim 1 wherein the ratio of the temporal duration of the fastest response to the slowest response capable of being displayed by said display as a result of said modifying has a factor of less than 3 times.

5. The method of claim 1 wherein the ratio of the temporal duration of the fastest response to the slowest response capable of being displayed by said display as a result of said modifying has a factor of less than 2 times.

6. The method of claim 1 wherein the ratio of the temporal duration of the fastest response to the slowest response capable of being displayed by said display as a result of said modifying has a factor of less than 1 time.

7. The method of claim 1 wherein the ratio of the temporal duration of the fastest response to the slowest response of a majority of the transitions capable of being displayed by said display as a result of said modifying has a factor of less than 3 times.

8. The method of claim 1 wherein the ratio of the temporal duration of the fastest response to the slowest response of a greater than 75% of the transitions capable of being displayed by said display as a result of said modifying has a factor of less than 3 times.

9. The method of claim 1 wherein the ratio of the temporal duration of the fastest response to the slowest response of a greater than 85% of the transitions capable of being displayed by said display as a result of said modifying has a factor of less than 3 times.

10. The method of claim 1 wherein the ratio of the temporal duration of the fastest response to the slowest response of a greater than 95% of the transitions capable of being displayed by said display as a result of said modifying has a factor of less than 3 times.

11. The method of claim 1 wherein the ratio of the temporal duration of the fastest response to the slowest response of a greater than 97% of the transitions capable of being displayed by said display as a result of said modifying has a factor of less than 3 times.

12. The method of claim 1 wherein the ratio of the temporal duration of the fastest response to the slowest response of a greater than 100% of the transitions capable of being displayed by said display as a result of said modifying has a factor of less than 3 times.

13. The method of claim 1 wherein the ratio of the temporal duration of the fastest response to the slowest response of a majority of the transitions capable of being displayed by said display as a result of said modifying has a factor of less than 1 time.

14. The method of claim 1 wherein the ratio of the temporal duration of the fastest response to the slowest response of a greater than 75% of the transitions capable of being displayed by said display as a result of said modifying has a factor of less than 1 time.

15. The method of claim 1 wherein the ratio of the temporal duration of the fastest response to the slowest response of a greater than 85% of the transitions capable of being displayed by said display as a result of said modifying has a factor of less than 1 time.

16. The method of claim 1 wherein the ratio of the temporal duration of the fastest response to the slowest response of a greater than 95% of the transitions capable of being displayed by said display as a result of said modifying has a factor of less than 1 time.

17. The method of claim 1 wherein the ratio of the temporal duration of the fastest response to the slowest response of a greater than 97% of the transitions capable of being displayed by said display as a result of said modifying has a factor of less than 1 time.

18. The method of claim 1 wherein the ratio of the temporal duration of the fastest response to the slowest response of a greater than 100% of the transitions capable of being displayed by said display as a result of said modifying has a factor of less than 1 time.

19. The method of claim 1 wherein said modification results from using an IIR filter.

20. The method of claim 1 wherein said modification is based upon using a high pass filter and a low pass filter.

21. The method of claim 1 wherein said modification is based upon previous frame data stored in a frame buffer and the driving circuitry for said display uses said frame buffer.

22. The method of claim 21 wherein said frame buffer has sufficient storage for 75% or more of a frame.

23. The method of claim 21 wherein said frame buffer has sufficient storage for 95% or more of a frame.

24. The method of claim 21 wherein said frame buffer has sufficient storage for 100% or more of a frame.

25. The method of claim 21 wherein said frame buffer has sufficient storage for 110% or less of a frame.

26. The method of claim 21 wherein said frame buffer has sufficient storage for 125% or less of a frame.

27. The method of claim 21 wherein said frame buffer has sufficient storage for less than 200% a frame.

28. The method of claim 1 wherein said modification is independent of the spatial position of any pixel being modified within said display.

29. A liquid crystal display for displaying an image wherein an input image to said display is modified in such a manner that, as a result of said modification, for a majority of the pixels capable of being displayed by said display, the ratio of the temporal duration of the fastest response of a pixel transitioning from a luminance value of a first frame to that of a second frame to the slowest response of a pixel transitioning from a luminance value of a first displayed frame to that of a second displayed frame has a factor of less than 5 times and wherein said input image to said display is modified to increase the temporal response of at least one pixel of said display when transitioning to a luminance value of said second displayed frame and simultaneously slow the temporal response of at least one pixel of said display when transitioning to a luminance value of said second displayed frame of said image.

30. The display of claim 29 wherein said factor is less than 3 times.

31. The display of claim 29 wherein said factor is less than 2 times.

32. The display of claim 29 wherein said factor is less than 1 time.

33. The display of claim 29 wherein said ratio of the temporal duration of the fastest response to the slowest response is greater than 75% of the transitions capable of being displayed.

34. The display of claim 29 wherein said ratio of the temporal duration of the fastest response to the slowest response is greater than 85% of the transitions capable of being displayed.

35. The display of claim 29 wherein said ratio of the temporal duration of the fastest response to the slowest response is greater than 95% of the transitions capable of being displayed.

36. The display of claim 29 wherein said ratio of the temporal duration of the fastest response to the slowest response is greater than 97% of the transitions capable of being displayed.

37. The display of claim 29 wherein said ratio of the temporal duration of the fastest response to the slowest response is greater than 100% of the transitions capable of being displayed.

* * * * *

UNITED STATES PATENT AND TRADEMARK OFFICE

CERTIFICATE OF CORRECTION

PATENT NO. : 7,046,262 B2
APPLICATION NO. : 10/404204
DATED : May 16, 2006
INVENTOR(S) : Xiao-fan Feng and Scott Daly It is certified that error appears in the above-identified patent and that said Letters Patent is hereby corrected as shown below:

Col. 2, lines 13-14
Change "EPO 951 007 B1" to read -- EP 0 951 007 B1--.

Col. 3, line 33
Change "maybe" to read --may be--.

Col. 3, line 63
Change "from lack" to read --from black--.

Signed and Sealed this

First Day of May, 2007

JON W. DUDAS
*Director of the United States Patent and Trademark Office*